United States Patent [19]

Boby

[11] Patent Number: 4,542,358

[45] Date of Patent: Sep. 17, 1985

[54] DEVICE PROTECTING A COAXIAL CABLE AGAINST HIGH-POWERED, LOW-FREQUENCY SPURIOUS PULSES

[75] Inventor: Joël Boby, Montfermeil, France

[73] Assignee: Societe Anonyme Dite: les Cables de Lyon, Clichy, France

[21] Appl. No.: 455,457

[22] Filed: Jan. 4, 1983

[30] Foreign Application Priority Data

Jan. 5, 1982 [FR] France ..... 82 00032

[51] Int. Cl.[4] ..... H01P 5/00

[52] U.S. Cl. ..... 333/246; 333/12; 333/35; 333/260; 361/107; 361/118

[58] Field of Search ..... 333/12, 128, 127, 35, 333/33, 116, 115, 124, 125, 260, 246, 243, 238; 361/107, 110, 118

[56] References Cited

U.S. PATENT DOCUMENTS 3,164,790 1/1965 Oh ..... 333/116

3,970,969 7/1976 Sirel et al. ..... 333/12

3,976,959 8/1976 Gaspari ..... 333/26

4,424,500 1/1984 Viola et al. ..... 333/128

*Primary Examiner*—Eugene R. LaRoche

*Assistant Examiner*—Benny T. Lee

*Attorney, Agent, or Firm*—Sughrue, Mion, Zinn, Macpeak & Seas

[57] ABSTRACT

Device protecting a coaxial cable against high-powered low-frequency spurious pulses. A lightweight, compact device comprising a microstrip T-junction (5) folded back in the shape of an E on a substrate (6) integral to a single ground plate (7), with the branches of the E between the center point A and the coaxial plugs (1, 2) forming a quarter wavelength, as does the center horizontal branch of the E between points A and B. According to one of the variants, two microstrips arranged in parallel and separated by a dielectric substrate establish a quarter-wave trap. Application to microstrip resonant circuits.

6 Claims, 3 Drawing Figures

DEVICE PROTECTING A COAXIAL CABLE AGAINST HIGH-POWERED, LOW-FREQUENCY SPURIOUS PULSES

FIELD OF THE INVENTION

The present invention relates to a device protecting a coaxial cable against high-powered, low-frequency spurious pulses, specifically against electric discharges coming from disturbances ranging in frequency from a few hertz to a few megahertz whereas the coaxial cable's design frequency may range from approximately thirty megahertz to a few gigahertz.

BACKGROUND OF THE INVENTION

The relevant prior art as per French Pat. No. 73 45204 enhances the transmission of wanted signals and blocks spurious signals by means of a T-junction or a coaxial line trap based upon the principle of filtering by transforming the impedance of a quarter-wave line.

Accordingly, a quarter-wave line terminated at one end by a short circuit or an open circuit returns to the other end an infinite impedance or zero impedance, respectively. A classic example of such a circuit using coaxial lines is shown in FIG. 1, in which coaxial input plug 1 and output plug 2 for the operating signal are disposed in a T-junction wherein each of the lateral arms and the transverse arm are the same length as the quarter wavelength of the design frequency. At the end of the transverse arm, a short circuit 3 across the outside shield of the T and the center conductor returns to the center 4 of the T across the center conductor and the outside shield an impedance which is infinite with respect to the design frequency and practically null with respect to the disturbance frequency signals. Moreover, the lateral arms of the T, have a combined length that is half the wavelength of the operating frequency and impart a coupling between the two coaxial connectors 1 and 2.

However, the T-junction and the trap of the prior art device, made of a rigid metal conductor such as copper, are heavy and bulky as their largest mechanical dimension is equal to a half wavelength.

The device according to the present invention remedies this inconvenience. Said device provides an efficient protection against highpowered spurious signals whilst having more compact dimensions, making it less cumbersome and lighter.

SUMMARY OF THE INVENTION

The present invention relates to a device providing protection for a coaxial cable against high-powered, low-frequency spurious pulses, comprising quarter-wave transmission line impedance transformers, wherein said transmission lines are made of curved microstrip thereby improving the overall compactness of the device.

In one embodiment of the invention, the device, comprising coaxial input and output plugs for the operating signals and a T-junction, the lateral arms and the transverse arm of which each form a quarter of a wavelength at the operating frequency, features a microstrip conductor laid on a dielectric substrate integral with a ground plate, said microstrip having its two lateral arms curved and forming with its transverse arm an E-shape configuration, such that each of the lateral arms connects with a respective center conductor of said coaxial plug, whose outside shield is connected to the said ground plate, and the transverse arm, or horizontal center bar of the E is folded over the side of said substrate to connect with said ground plate.

In another embodiment of the invention, a device comprising coaxial input and output plugs for the operating signals and a trap consisting of two microstrip impedance transformers, where said impedance transformers form an open circuited gap, features two microstrips curved and disposed respectively between a first and a second dielectric substrates and between a second and a third dielectric substrates, such that a first and a second ground plate cover the outside surface of said respective first and third dielectric substrates, the outside shields of said coaxial plugs being connected to at least one of said ground plates, said plugs being arranged approximately symmetrically with respect to two facing portions of the two microstrips, said portions being equal in length to a quarter wavelength with the curved sections of each of the two microstrips being connected to center conductors of respective coaxial plugs.

In a third embodiment of the invention, said ground plates and/or microstrips are fabricated by screen deposition; by etching, by spray deposition, or by electrolytic deposition.

In a fourth embodiment of the invention, said substrates are made of a dielectric material of the filled or unfilled polymer group (such as polymer-glass), or ceramics (alumina, beryllium oxide, titanium dioxide for example), enamels, etc.

Nonlimitative examples of embodiments of the present invention are described below with reference to the accompanying drawings.

DESCRIPTION OF THE PREFERRED EMBODIMENT

Figure 1:
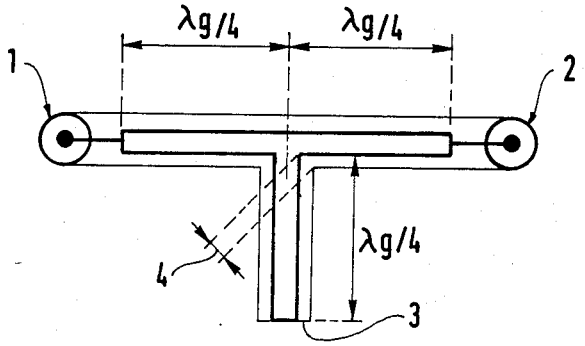
FIG.1 (PRIOR ART)
FIG. 1 is a circuit diagram of a coaxial-type T-junction according to the prior art.
Figure 2:
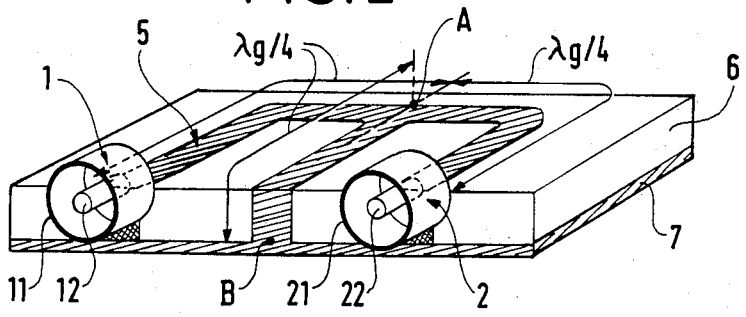
FIG. 2 is a schematic perspective view of a T-junction according to the invention.

FIG. 2 shows two coaxial plugs 1 and 2 providing an input and an output for the very high frequency and hyperfrequency (microwave) design signals. The device, a quarter-wave T, serves to uncouple the spurious signals coming, for example, from high-powered, low frequency electromagnetic pulses. The T comprises a microstrip conductor 5, which may be either a conductive ink deposited by silkscreening or a conductive metal shaped by etching.

The microstrip 5 is supported by one side of the dielectric substrate 6. On the opposite side of the substrate 6 is placed a ground plate 7 covering the surface entirely and fabricated in the same manner as microstrip 5.

Outside shields 11 and 21 of coaxial plugs 1 and 2 are joined with the ground plate 7, by a welding process for example. The center conductors 12 and 22 of the coaxial plugs 1 and 2 are connected to the E-shaped microstrip 5 respectively at the lower and upper horizontal sides of the E. Dimension A-12 and A-22 are equal to $\lambda g/4$. In addition, the center horizontal bar of the E is extended and folded over the side to a point B on the side of substrate 6 to link up and integrate with ground plate 7. Dimension A-B is also equal to $\lambda g/4$. The length of guided wave $\lambda g$ is obtained from the wavelength in a vacuum $\lambda o$ following the equation $$\lambda g = \lambda o / \epsilon_r^{\frac{1}{2}}$$

Consequently, a device with much smaller dimensions than those of the prior art T-junction may be obtained by using a microstrip with an E shape and a high permitivity substrate. The width of the microstrip determines its impedance factor, making it possible, through a careful choice of impedance rating, to increase the bandwidth of the device, said device possibly being installed in a metal housing serving as a Faraday cage.

Figure 3:
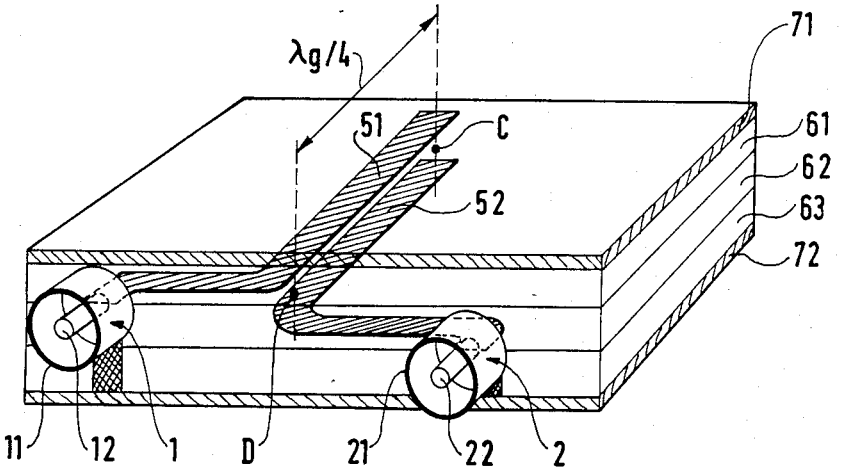
FIG. 3 is a schematic of a quarter-wave trap according to the invention.

FIG. 3 provides an example of a quarter-wave trap disposed between two coaxial plugs 1 and 2. Three dielectric substrates 61, 62, 63 which can be made of the same materials as in FIG. 2 are placed in layers between two ground plates 71 and 72. Microstrips 51 and 52 are disposed, respectively, between substrates 61 and 62 and between substrates 62 and 63, either on substrates 61 and 63 or on opposite sides of substrate 62. They are metallized following the same procedure as per FIG. 2. Microstrips 51 and 52 are connected respectively to center conductors 12 and 22 of coaxial plugs 1 and 2. Between two ends of the microstrips 51 and 52, labelled point C (open circuit end) and a point D at which the microstrips are bent at right angles in opposing directions towards the center conductors 11 and 12, the front-facing portions of microstrips 51 and 52 constitute a quarter-wave portion of a guided wave. The open circuit C returns to D a circuit of zero impedance at the design frequency and a trap for DC signals or lower frequency signals.

The protection device according to the present invention is of the microstrip resonant circuits type.

I claim:

1. A device protecting a coaxial cable against high-powered low-frequency spurious pulses, said device comprising: quarter-wave length transmission line impedance transformers made of a microstrip, at least one portion (5) of said microstrip being equal in length to an odd multiple of $\lambda g/4$, wherein $\lambda g$ is the wave length of a guided wave on said microstrip, said portion being curved in the same plane in order to reduce the overall dimensions of the device; said device further comprising coaxial plugs (1, 2) for the input and output of operating signals, said impedance transformers forming a T-junction, having two lateral arms and a transverse arm of which each arm being a quarter wavelength at the frequency of the design signal, said T-junction consisting of said microstrip (5) being disposed on a dielectric substrate (6), said substrate being integral with a ground plate (7), said two lateral arms and said transverse arm of said T-junction being configured in the shape of an E, each of the two lateral arms being curved so as to connect with a center conductors (12, 22) of said coaxial plug (1, 2), an outside shield (11, 21) of each coaxial plug being connected to said ground plate (7) and the center transverse arm of the E being bent over the side of the substrate (6) and connected to said ground plate (7).

2. A device protecting a coaxial cable against high-powered low-frequency spurious pulses, said device comprising: quarter-wave length transmission line impedance transformers made of two microstrips, at least one portion (51, 52) of each of said microstrips being equal in length to an odd multiple of $\lambda g/4$, wherein $\lambda g$ is the wavelength of a guided wave on said microstrips, said microstrips being curved in respective planes in order to reduce the overall dimensions of the device, said device further comprising coaxial plugs (1, 2) for the input and output of operating signals and said impedance transformers comprising a trap consisting of an open-circuited gap defined by said two curved microstrip portions (51, 52), said microstrips disposed respectively between first and second (61, 62) dielectric substrates and between second and third (62, 63) dielectric substrates, a first ground plate (71) and a second ground plate (72) covering the outside surfaces of said first (61) and third (63) dielectric substrates respectively, outside shields (11, 21) of said coaxial plugs (1, 2) being connected to at least one of said ground plates (71, 72), said plugs (1, 2) being arranged approximately symmetrically with respect to the two microstrips (51, 52), said portions being equal in length to a quarter wavelength, and sections of each of said two microstrips (51, 52) being curved at right angles in opposing directions and connected to respective center conductors (12, 22) of said coaxial plugs (1, 2).

3. A device as in claim 1, wherein said ground plates (7, 71, 72) and microstrips (5, 51, 52) comprise silk-screened elements.

4. A device as in claim 1, wherein said ground plates (7, 71, 72) and microstrips (5, 51, 52) are chemically etched electrolytic deposited elements.

5. A device as in claim 1, wherein said substrates (6, 61, 62, 63) are a dielectric material selected from the group consisting of filled polymer group, unfilled polymer group, ceramics and enamel.

6. A device as in claim 1, wherein said ground plates comprise spray metallized elements.

* * * * *